US009416673B2

(12) United States Patent
Caprario et al.

(10) Patent No.: US 9,416,673 B2
(45) Date of Patent: Aug. 16, 2016

(54) HYBRID INNER AIR SEAL FOR GAS TURBINE ENGINES

(75) Inventors: Joseph T. Caprario, Cromwell, CT (US); Russell J. Bergman, Windsor, CT (US); Pamela A. Humphrey, Windsor, CT (US); Jonathan Perry Sandoval, East Hartford, CT (US)

(73) Assignee: United Technologies Corporation, Hartford, CT (US)

( * ) Notice: Subject to any disclaimer, the term of this patent is extended or adjusted under 35 U.S.C. 154(b) by 929 days.

(21) Appl. No.: 13/351,290

(22) Filed: Jan. 17, 2012

(65) Prior Publication Data

US 2013/0183145 A1 Jul. 18, 2013

(51) Int. Cl.

| | |
|---|---|
| ***F01D 11/02*** | (2006.01) |
| ***F01D 9/04*** | (2006.01) |
| ***F01D 11/00*** | (2006.01) |

(52) U.S. Cl.

CPC ..... *F01D 11/001* (2013.01); *F01D 9/04* (2013.01); *F01D 11/025* (2013.01)

(58) Field of Classification Search

CPC ..... F01D 11/001; F01D 11/02; F01D 11/025; F01D 9/04

USPC ..... 415/170.1, 171.1, 173.1, 173.3, 173.5, 415/173.6, 173.7, 174.1, 174.2, 174.3

See application file for complete search history.

(56) References Cited

U.S. PATENT DOCUMENTS

| | | | | |
|---|---|---|---|---|
| 5,503,528 | A | 4/1996 | Glezer et al. | |
| 6,152,690 | A * | 11/2000 | Tomita et al. | 415/173.7 |
| 6,558,114 | B1 * | 5/2003 | Tapley | F01D 11/001 415/111 |
| 7,059,821 | B2 * | 6/2006 | Farrell et al. | 415/1 |
| 7,249,769 | B2 | 7/2007 | Webster | |
| 7,540,709 | B1 * | 6/2009 | Ebert | 415/173.7 |
| 2002/0004006 | A1 * | 1/2002 | Briesenick et al. | 415/173.7 |
| 2005/0175446 | A1 | 8/2005 | Garner | |
| 2006/0239816 | A1 * | 10/2006 | Labbe et al. | 415/230 |
| 2007/0014668 | A1 | 1/2007 | Engle | |
| 2007/0059158 | A1 * | 3/2007 | Alvanos | F01D 5/081 415/115 |
| 2007/0098545 | A1 * | 5/2007 | Alvanos et al. | 415/170.1 |
| 2010/0074734 | A1 * | 3/2010 | Little | 415/173.7 |
| 2011/0072831 | A1 * | 3/2011 | Tanimura | 60/805 |
| 2011/0182721 | A1 * | 7/2011 | Saunders | 415/173.7 |
| 2011/0243715 | A1 * | 10/2011 | Strock | 415/173.4 |
| 2011/0243722 | A1 * | 10/2011 | Murphy et al. | 415/208.1 |

FOREIGN PATENT DOCUMENTS

| | | | |
|---|---|---|---|
| GB | 2307520 | A | 5/1997 |
| GB | 2438858 | A | 12/2007 |

OTHER PUBLICATIONS

European Search Report for European Application No. 13150426.8 completed on Feb. 11, 2014.

* cited by examiner

*Primary Examiner* — Igor Kershteyn
*Assistant Examiner* — Christopher R Legendre
(74) *Attorney, Agent, or Firm* — Carlson, Gaskey & Olds, PC

(57) ABSTRACT

A turbine section has a turbine rotor carrying turbine blades. The turbine blades include seal members at a radially inner location. A vane section is formed of a plurality of circumferentially spaced vane components, each of which has an airfoil extending radially outwardly of a platform. A first seal member is fixed to the platform, and is positioned to be adjacent a seal from a blade which is positioned in one axial direction relative to the first seal member. A second seal member extends circumferentially beyond at least a plurality of the vane components and is positioned to be adjacent a seal member of a blade on an opposed axial side from the first blade. A vane component is also disclosed and claimed.

16 Claims, 2 Drawing Sheets

HYBRID INNER AIR SEAL FOR GAS TURBINE ENGINES

BACKGROUND OF THE INVENTION

This application relates to an inner air seal for use with a vane in a gas turbine engine.

Gas turbine engines are known, and typically include a compressor compressing air and delivering it into a combustion section. The air is mixed with fuel in the combustion section and ignited. Products of this combustion pass downstream over a turbine section, driving turbine rotors to rotate.

In the turbine section, the control of gas flow is important to achieve efficient operation. One feature of the turbine section is that there are stages of turbine rotors carrying turbine blades, and intermediate static vanes between the stages. It is desirable to prevent or limit the flow of gas through radially inner locations at the vanes.

Thus, the turbine blades have typically been provided with so-called knife edge seals that extend toward a seal carried by the vane.

In one type of seal, a generally continuous blade seal extends circumferentially beyond discrete vane bodies. This type of seal must be mounted to allow radial adjustment between the seal and the several vane bodies.

Another type of seal is segmented and fixed to each of the individual vane bodies.

During some periods of operation, the continuous vane seals may provide better sealing, however, under other periods of operation, the segmented seals will provide better sealing.

SUMMARY OF THE INVENTION

In a featured embodiment, a turbine section includes at least a first and second turbine rotor each carrying turbine blades. The rotors each have at least one rotating seal at a radially inner location. A vane section is formed of a plurality of circumferentially spaced vane components. A first seal is fixed to the platform, and has a seal material positioned to be adjacent the at least one rotating seal from the first rotor, and positioned in one axial direction relative to the first seal. A second seal extends circumferentially beyond at least a plurality of the vane components, and has a seal material positioned to be adjacent at least one rotating seal from the second rotor and on an opposed side from the first rotor.

In another embodiment, the second seal is circumferentially continuous.

In an embodiment according to the previous embodiment, the second seal is connected to the platforms of the plurality of vane components, but is radially movable relative to the platforms.

In another embodiment according to the prior embodiments, each of the plurality of circumferentially spaced vane components includes a plurality of vane members.

In another embodiment according to the prior embodiments, the first and second seals include a material mounted onto a seal mount, and the material is more abradable than the material forming the mount.

In an embodiment according to the prior embodiment, a first arm is fixed to the platform and extends radially inwardly in an opposed direction from the airfoil. The first arm extends to a seal mount for the first seal, and a second arm extends radially inwardly from the platform, and includes a connection to connect the second seal, and allow radial movement.

In another embodiment according to the prior embodiments, at least the second seal is a non-contact seal.

In another featured embodiment, a vane component includes a vane having an airfoil extending radially outwardly of a platform. A first seal is fixed to the platform, and has a seal material positioned to be adjacent at least one rotating seal which is positioned in one axial direction relative to the first seal when the vane component is positioned in a turbine section. A second seal extends circumferentially beyond the vane component, and has seal material positioned to be adjacent at least one rotating seal when the vane component is positioned in a turbine section.

In another embodiment, the second seal is circumferentially continuous.

In an embodiment according to the previous embodiment, the second seal is connected to the platforms of the plurality of vane components, but is radially movable relative to the platforms.

In another embodiment according to the prior embodiments, each of the plurality of circumferentially spaced vane components includes a plurality of vane members.

In another embodiment according to the prior embodiments, the first and second seals include a material mounted onto a seal mount, and the material is more abradable than the material forming the mount.

In an embodiment according to the prior embodiment, a first arm is fixed to the platform and extends radially inwardly in an opposed direction from the airfoil. The first arm extends to a seal mount for the first seal, and a second arm extends radially inwardly from the platform, and includes a connection to connect the second seal, and allow radial movement.

In an embodiment according to the prior embodiment, at least the second seal is a non-contact seal.

In another featured embodiment, a vane component has an airfoil extending radially outwardly of a platform. A first seal is fixed to the platform, and has a seal material positioned to be adjacent at least one rotating seal from a first rotor positioned in one axial direction relative to the first seal when the vane component is positioned in a turbine section. A second seal extends circumferentially beyond the vane component, and has a seal material positioned to be adjacent at least one rotating seal of a second rotor when the vane component is positioned in a turbine section and on an opposed side from the first rotor. The second seal is circumferentially continuous and connected to the platform of the vane component, but is radially movable relative to the platform. The first and second seal include a material mounted onto a seal mount, and the material is more abradable than a material forming the mount. A first arm is fixed to the platform and extends radially inwardly in an opposed direction from the airfoil, and with the first arm extending to the seal mount for the first seal. A second arm extends radially inwardly from the platform and the second arm includes a connection to the mount of the second seal that allows the radial movement.

These and other features of the present invention may be best understood from the following specification and drawings.

DETAILED DESCRIPTION

Figure 1:
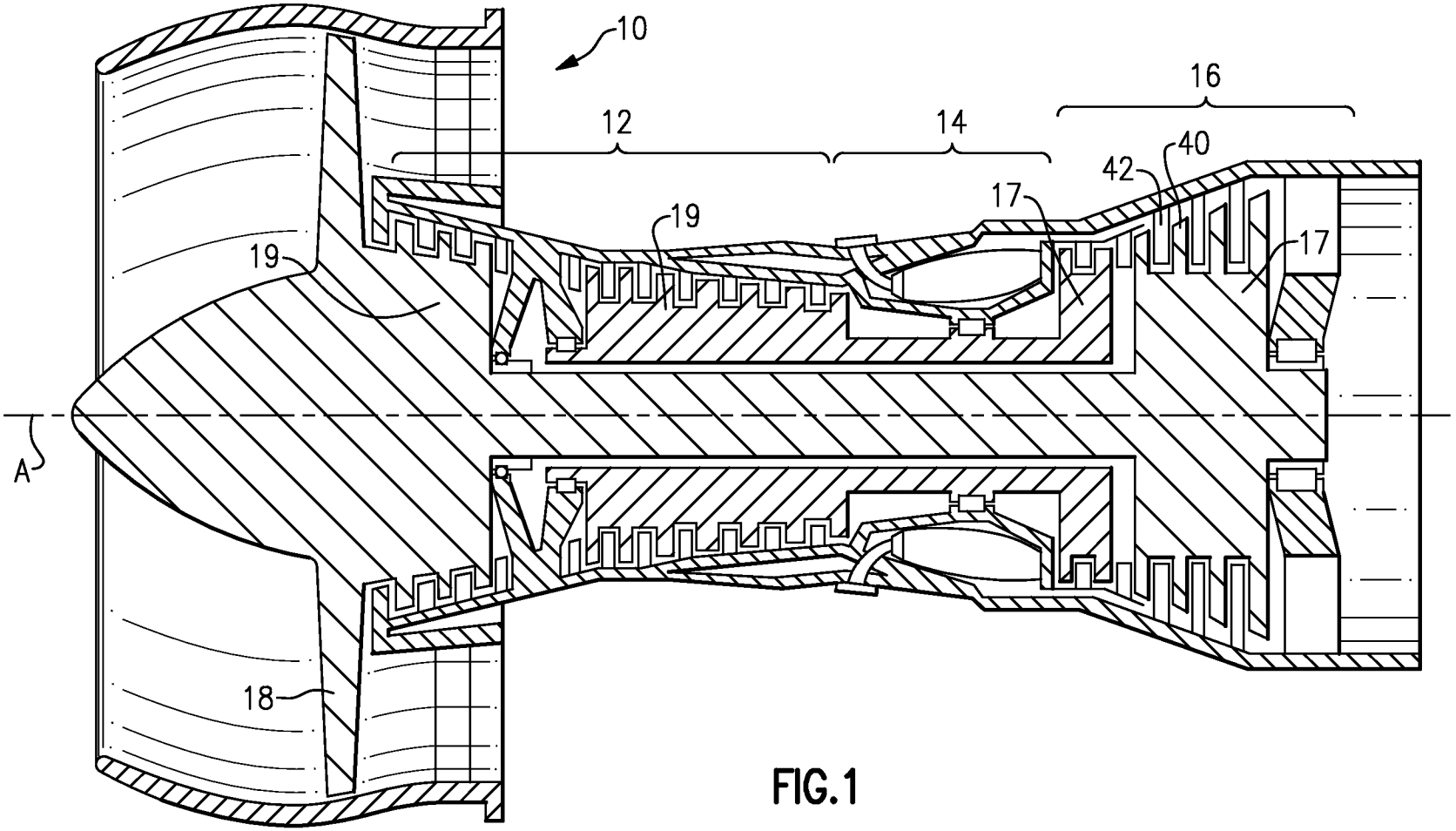
FIG. 1 shows a schematic gas turbine engine.

FIG. 1 shows a general gas turbine engine 10, such as a turbofan gas turbine engine, circumferentially disposed about an engine centerline A. The engine 10 includes a fan 18, a compressor 12, a combustion section 14 and turbine section 16. As is well known in the art, air compressed in the compressor 12 is mixed with fuel which is burned in the combustion section 14 and expanded across a turbine section 16. The turbine section 16 includes rotors 17 that rotate in response to the expansion, driving compressor rotors 19 and fan 18. The turbine rotors 17 carry blades 40. Fixed vanes 42 are positioned intermediate rows of blades. This structure is shown somewhat schematically in FIG. 1. While one example gas turbine engine is illustrated, it should be understood this invention extends to any other type gas turbine engine for any application.

Figure 2:
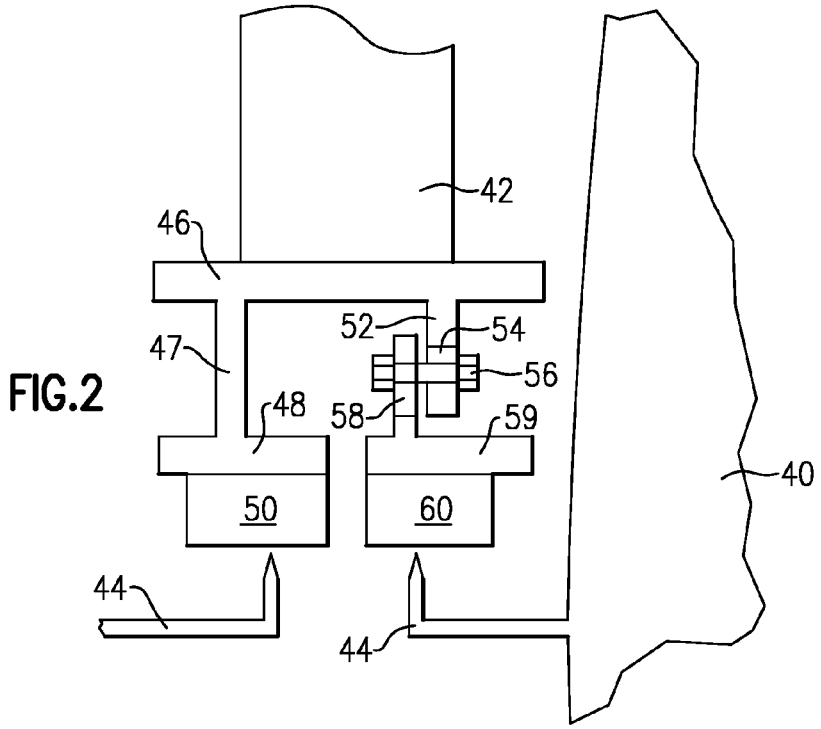
FIG. 2 shows an inventive arrangement.

FIG. 2 shows a vane 42 positioned adjacent to a turbine blade 40. As known, both vane 42 and turbine blade 40 have airfoils extending as shown in partial view in FIG. 2. The blade 40 carries knife edge seals 44 which extend toward inner seals 50, 60 associated with the vane 42. The vane 42 has a platform 46 that extends to a first arm 47 which is formed integrally with a mount structure 48. The mount structure 48 carries an abradable seal material 50.

The mount 48 and material 50 is fixed to the platform 46, and will generally extend through a circumferential extent similar to that of platform 46.

A second arm 52 extends inwardly from the platform 46 and may include a slot 54. The slot 54 receives a pin 56 that is attached to a tab 58 from another seal mount 59. The seal mount 59 mounts abradable seal material 60.

Figure 3:
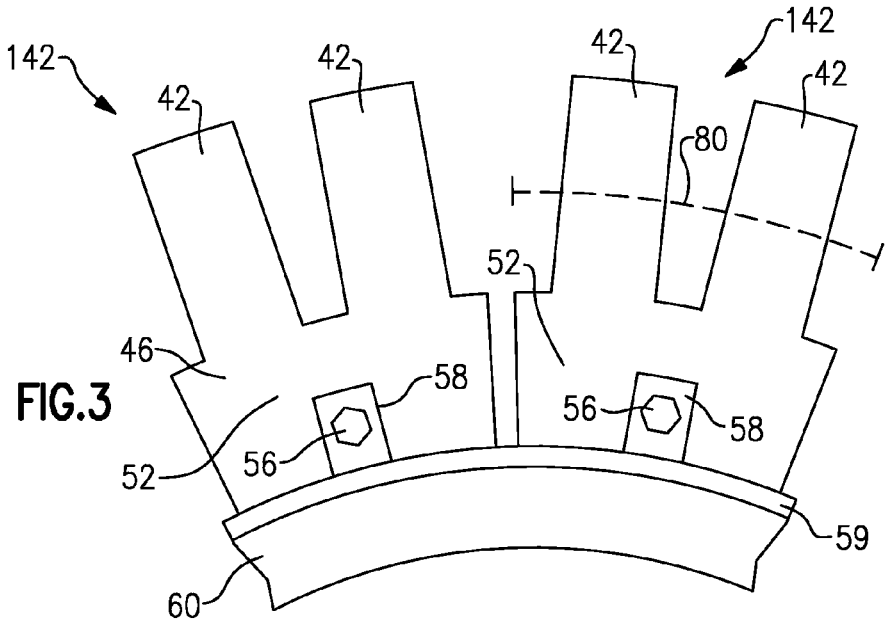
FIG. 3 is a view taken generally at 90° to the FIG. 2 view.

The seal 60 extends circumferentially beyond the extent of any one of the Vane components 142 (see FIG. 3). As shown, the vane components 142 may carry plural vanes 42. One or more than two vanes may be included in components within the scope of this application. The fixed seal mount 48 and seal 50 (although not shown in this view) extend Between approximate limits 80, shown in phantom in FIG. 3, generally about a similar circumferential extent as components 142. Thus, the seal mount 48 and its abradable seal 50 do not extend to an adjacent vane component 142, but instead are fixed with each vane component 142. Stated another way, seal 60 extends for a greater circumferential extent than seal 50.

On the other hand, as is clear, the continuous seal mount 59, and its abradable seal 60 extends circumferentially beyond the extent of any one vane component. In practice, the mount 59 and seal material 60 may extend for a full ring.

The seals 50 and 60 are formed of a material that is more abradable than the surface of the platform 46 or mounts 59 and 48.

In addition, as can be appreciated from FIG. 2, one of the seals 50 is positioned to be adjacent a seal 44 from one blade 40 on a first axial side of vane 42, and the other seal 60 is positioned to be adjacent a seal 44 from a blade 40 on an opposed axial side.

The description as set forth above is relatively simplified, and in particular with regard to the seals 44. In fact, the seals 44 may be completely separate from the turbine blades, and could be a continuous seal member. What is true is the two seals 44 shown in FIG. 2 would be appreciated with separate rotors, and would rotate with those rotors. In addition, while one knife edge is shown for each seal 44, any number of additional knife edges could be utilized.

Figure 4:
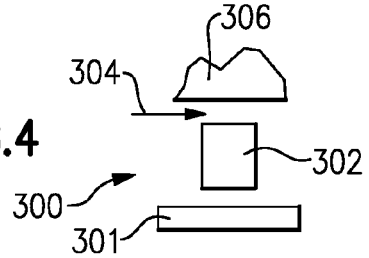
FIG. 4 shows an alternate embodiment of a seal.

Finally, while abradable seals are illustrated, the teachings of this application would extend to other types of seals, such as floating or non-contact seals (e.g., those available under the trade name "halo"). Such an embodiment is shown somewhat schematically in FIG. 4, wherein the rotating component 301 is not a knife edge. Instead, the non-contact or floating seal system 300 includes a seal member 302 that is movable relative to the mount portion 306. Some fluid pressure 304 biases the seal portion 302 toward the rotating component 301. It should be understood that this application extends to this type of seal, and any number of other types of seals. This type of non-contact seal would typically be provided on the circumferentially continuous seal portion.

The combination thus provides the benefit of both types of seal materials, and provides synergistic benefits in ensuring adequate and desirable sealing under all conditions.

Although an embodiment of this invention has been disclosed, a worker of ordinary skill in this art would recognize that certain modifications would come within the scope of this invention. For that reason, the following claims should be studied to determine the true scope and content of this invention.

The invention claimed is:

1. A turbine section comprising:

first and second turbine rotors each carrying turbine blades for rotation about a central axis, said rotors each having at least one rotating seal at a radially inner location;

a vane section formed of a plurality of circumferentially spaced vane components, each of said vane components having an airfoil extending radially outwardly of a platform;

a first seal fixed to said platform, said first seal having a seal material positioned to be adjacent said at least one rotating seal from the first rotor which is positioned in one axial direction relative to said first seal;

a second seal extending circumferentially beyond at least a plurality of said vane components, said second seal having seal material positioned to be adjacent said at least one rotating seal of the second rotor on an opposed axial side from said first rotor, the second seal extends for a greater circumferential extent than does the first seal;

said first and second seals include said seal material mounted onto a seal mount, and wherein said material is more abradable than a material forming said mount; and a first arm is fixed to said platform and extends radially inwardly in an opposed direction from said airfoil, with said arm extending to said seal mount for said first seal, and a second arm extending radially inwardly from platform, with said second arm including a connection to said mount for said second seal that allows movement.

2. The turbine section as set forth in claim 1, wherein said second seal is circumferentially continuous.

3. The turbine section as set forth in claim 2, wherein said second seal is connected to said platforms of said plurality of vane components, but is radially movable relative to said platforms.

4. The turbine section as set forth in claim 1, wherein each of said plurality of circumferentially spaced vane components includes a plurality of vane members.

5. The turbine section as set forth in claim 1, wherein at least said second seal is a non-contact seal.

6. The turbine section as set forth in claim 1, wherein said first seal extends for a circumferential extent similar to that of said platform.

7. The turbine section as set forth in claim 1, wherein one of said second arm and said mount for said second seal has a slot that receives a pin to provide said connection to allow said radial movement.

8. A vane and seal comprising:

a vane component having an airfoil extending radially outwardly of a platform;

a first seal fixed to said platform, said first seal having a seal material positioned to be adjacent at least one rotating seal which is positioned in one axial direction relative to said first seal when the vane component is positioned in a turbine section;

a second seal extending circumferentially beyond said vane component, said second seal having seal material positioned to be adjacent at least one rotating seal when the vane component is positioned in a turbine section, and on an opposed axial side from the one axial direction;

wherein said second seal is connected to said platform of said vane component, but is radially movable relative to said platform, the second seal extends for a greater circumferential extent than does the first seal;

said first and second seal includes a said material mounted onto a seal mount, and wherein said material is more abradable than a material forming said mount; and a first arm is fixed to said platform and extends radially inwardly in an opposed direction from said airfoil, with said first arm extending to said seal mount for said first seal and a second arm extending radially inwardly from said platform, with said second arm including a connection to said mount for said second seal that allows said radial movement.

9. The vane and seal as set forth in claim 8, wherein said second seal is circumferentially continuous.

10. The vane and seal as set forth in claim 8, wherein said vane component includes a plurality of vane members.

11. The vane and seal as set forth in claim 8, wherein said second seal is a non-contact seal.

12. The vane and seal as set forth in claim 8, wherein said first seal extends for a circumferential extent similar to that of said platform.

13. The vane and seal as set forth in claim 8, wherein one of said second arm and said mount for said second seal has a slot that receives a pin to provide said connection to allow said radial movement.

14. A vane and seal comprising:

a vane component having an airfoil extending radially outwardly of a platform; and a first seal fixed to said platform, said first seal having a seal material positioned to be adjacent at least one rotating seal from a first rotor which is positioned in one axial direction relative to said first seal when the vane component is positioned in a turbine section;

a second seal extending circumferentially beyond said vane component, said second seal having seal material positioned to be adjacent at least one rotating seal of a second rotor when the vane component is positioned in a turbine section, and on an opposed axial side from the first rotor;

said second seal being circumferentially continuous and connected to said platform of said vane component, but being radially movable relative to said platform;

said first and second seal including said seal material mounted onto a seal mount, and wherein said seal material being more abradable than a material forming said mount; and a first arm being fixed to said platform and extending radially inwardly in an opposed direction from said airfoil, with said first arm extending to said seal mount for said first seal, and a second arm extending radially inwardly from said platform, with said second arm including a connection to said mount for said second seal that allows said radial movement, the second seal extends for a greater circumferential extent than does the first seal.

15. The vane and seal as set forth in claim 14, wherein said first seal extends for a circumferential extent similar to that of said platform.

16. The vane and seal as set forth in claim 14, wherein one of said second arm and said mount for said second seal has a slot that receives a pin to provide said connection to allow said radial movement.

* * * * *